US008070894B2

(12) United States Patent
Branagan

(10) Patent No.: US 8,070,894 B2
(45) Date of Patent: Dec. 6, 2011

(54) HIGHLY ACTIVE LIQUID MELTS USED TO FORM COATINGS

(75) Inventor: Daniel James Branagan, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 0 days.

(21) Appl. No.: 10/776,472

(22) Filed: Feb. 11, 2004

(65) Prior Publication Data

US 2004/0250926 A1 Dec. 16, 2004

Related U.S. Application Data

(60) Provisional application No. 60/446,591, filed on Feb. 11, 2003.

(51) Int. Cl.
*C23C 4/08* (2006.01)
*C23C 4/00* (2006.01)

(52) U.S. Cl. ..... 148/529; 148/527; 148/530; 148/531; 420/8; 420/121; 420/122; 420/123; 427/455; 427/456; 427/576

(58) Field of Classification Search ..... 148/273–275, 148/525, 253, 527, 529–531; 428/647–648; 427/423, 455–456, 576; 420/443, 437–438, 420/8, 121–123
See application file for complete search history.

(56) References Cited

U.S. PATENT DOCUMENTS 3,904,382 A 9/1975 Beltran et al. ..... 29/194
4,031,278 A 6/1977 Patel ..... 427/423
4,348,433 A 9/1982 Kammer et al. ..... 427/423
4,361,604 A 11/1982 Kushner et al. ..... 427/423
4,381,943 A * 5/1983 Dickson et al. ..... 75/356
4,615,864 A 10/1986 Dardi et al. ..... 420/437
4,822,415 A * 4/1989 Dorfman et al. ..... 420/61
4,909,984 A 3/1990 Singheiser et al. ..... 420/443
5,643,531 A * 7/1997 Kim et al. ..... 420/64
6,125,912 A * 10/2000 Branagan et al. ..... 164/46
6,258,185 B1 * 7/2001 Branagan et al. ..... 148/525
6,302,975 B1 * 10/2001 Kung ..... 148/525

OTHER PUBLICATIONS

Surface Hardening of Steels: Understanding the Basics, Joseph R. Davis, ASM International, p. 8, Nov. 2002.*
International Search Report dated Mar. 8, 2005.
Written Opinion of the International Searching Authority dated Mar. 8, 2005.
Chinese Office Action dated Nov. 17,2006 received in corresponding Chinese Patent Application No. 2004800062873 (7 pages).

* cited by examiner

*Primary Examiner* — Roy King
*Assistant Examiner* — Lois Zheng
(74) *Attorney, Agent, or Firm* — Grossman, Tucker, Perreault & Pfleger, PLLC

(57) ABSTRACT

An alloy suitable for coating metal surfaces is provided in which the alloy provides a liquid melt which contains a fraction of dissolved oxide forming additives as deoxidizers. The alloyed combination of elements in the liquid melt resists compound formation thus preserving the chemical activity of the individual elements. In a coating application, the alloy may form a coating that can interact with and remove the oxide or residual oxide coating of the base metal to be coated, i.e., scrub the surface of the metal clean. This results in increased coating bond strength and the ability to bond effectively to normally difficult alloys such as stainless steel, refractory metals (W, Ti, Ta etc.), or aluminum alloys which form protective oxide layers.

4 Claims, 1 Drawing Sheet

Bond strength as a function of substrate and coating thickness for HVOF coupons. Note that in all the samples sprayed at 0.040", the failure was in the adhesive, indicating that the bond strength is greater than the values shown.

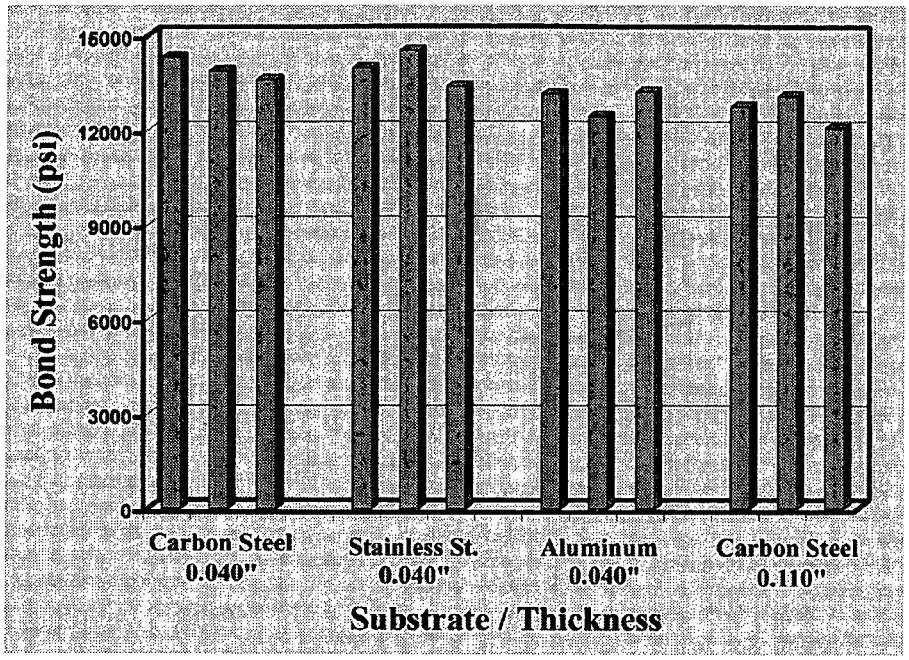
Figure 1 Bond strength as a function of substrate and coating thickness for HVOF coupons. Note that in all the samples sprayed at 0.040", the failure was in the adhesive, indicating that the bond strength is greater than the values shown.

HIGHLY ACTIVE LIQUID MELTS USED TO FORM COATINGS

CROSS REFERENCE TO RELATED APPLICATIONS

This application claims priority to U.S. Provisional Application No. 60/446,591 filed Feb. 11, 2003.

FIELD OF THE INVENTION

The present invention relates to coatings for metal surfaces, and more particularly to coatings that remove surface oxidation as applied. Accordingly, the invention provides distributed reducing agents in a metal composition which strategically combine with surface oxidized layers to provide improved bonding characteristics between the metal composition and the oxidized metal surface.

BACKGROUND OF THE INVENTION

All metals except for gold, form native oxide layers which act to passivate the metal surface. In some metals such as aluminum, the native oxide layer is adherent and prevents further corrosive attack of the oxidized surface. However, other materials such as iron form a native oxide layer which is nonadherent and spalls off leaving base metal susceptible to further oxidation, i.e., rusting. The tendency of metals to form native oxide layers is very strong due to the high thermodynamic stability of the resulting oxide which forms. When virgin metal surfaces are exposed to oxygen containing atmospheres, generally the native oxide layer grows to its full thickness in a short time and for very reactive metals such as aluminum, or chromium, either as a metal or when dissolved in stainless steel, the oxidation can occur in a few seconds. Even in experiments done at high vacuum such as $10^{-9}$ torr, virgin metal surfaces of these reactive metals will quickly form native oxide layers.

Unfortunately, the chemical bonding nature of metals is such that metallic materials typically do not bond well to ceramic materials, including metal oxides such an oxidized metal surface, which are formed including ionic bonds. This poor bonding is a function of the incompatible nature of the metallic bonds, which may be modeled as ion cores surrounded by a sea of shared free electrons, and ionic bonds which result from directional electron transfer from specific cation atoms to specific anion atoms.

The tendency of metals to form oxides on the surfaces thereof, and the incompatibility of metal to ceramic bonding presents serious obstacles in the field of metal coatings. For example, in thermal spraying of metal coatings, it is often very difficult to bond the metal coating to reactive metals or alloys such as stainless steel alloys, aluminum alloys, and refractory alloys such as tungsten, zirconium, and titanium. Even if the base reactive metal is degreased and subsequently grit blasted to expose virgin metal surface, the native oxide layer reforms at a very fast rate, before thermal deposition of coating can begin. To try to overcome this, often coupon preparation and subsequent spraying is done at high vacuum in a vacuum chamber. This adds considerable expense to the coating operation, and is only marginally effective for highly reactive metals.

SUMMARY OF THE INVENTION

A metallic alloy for coating a metal surface comprising a deoxidizing element, or a combination of deoxidizing elements, wherein said deoxidizing element reduces a metal-oxide layer on said metal surface. In method form, the present invention relates to a method of forming a metallic coating on a metal surface comprising providing a metallic coating alloy comprising a deoxidizing element, or combination of deoxidizing elements, melting said metallic coating alloy to a liquid state, or partially liquid state and applying said liquid melt of said metallic coating alloy to said metal surface. In a further process embodiment the present invention relates to a method of forming a metallic coating on a metal surface comprising, providing a metallic coating alloy comprising a deoxidizing element, melting said metallic coating alloy to a liquid state, applying said liquid melt of said metallic coating alloy to said metal surface wherein said metal surface contains an oxidized surface layer, reducing said oxidized surface layer; and forming a metallurgical bond at said location where said oxidized surface layer has been reduced by said deoxidizing element.

BRIEF DESCRIPTION OF THE DRAWINGS

The invention herein is disclosed in part with reference to preferred and exemplary embodiments, which description should be understood in conjunction with the accompanying figures, wherein:

FIG. 1 is a chart graphically illustrating bond strength as a function of substrate material and coating thickness for coatings applied using high velocity oxy-fuel spraying technique.

Description Of The Preferred Embodiments

According to a first aspect, the present invention is directed at a metallic alloy suitable for coating metal surfaces. The metallic alloy may form a highly active liquid melt that may be reactive with and remove surface oxidation of metal substrates to be coated. The metallic alloy preferably includes combinations of active oxide forming/deoxidizing elements. Exemplary active elements may include manganese, chromium, silicon, carbon, and boron.

According to another aspect of the invention is a method of coating a metal surface including applying to a metal surface a melt containing a coating metal alloy and at least one oxide forming/deoxidizing element. Applying the melt may include wire-arc spraying, plasma spraying, high velocity oxyfuel spraying, flame spraying, and similar application techniques. The oxide forming/deoxidizing element may include, for example, manganese, chromium, silicon, carbon, and boron.

The present invention is directed at activated liquid melts containing a selected fraction of deoxidizing, i.e., oxygen seeking elements. More generally, these elements may be classified as reducing agents. Such liquid melts therefore enhance the ability of the metallic coatings to bond to metals that have oxidized surface characteristics. The presence of the deoxidizing additive serves to interact with the oxidized surface features, which is important since the oxidized surface features operate to reduce bonding strength.

When the highly activated liquid melt contacts a native oxide layer of a metal, the native oxide may be reduced, thereby removing the oxygen from the surface of the base metal. This allows a metallic alloy melt to form with a higher relative degree of metallurgical bonds to the base metal of the coupon, part, device, or machine to be coated. By metallurgical bonds it is in reference to a metallic chemical bonding mechanism, as compared to a physical bonding (mechanical interaction due to surface irregularities). Accordingly, this ability to form relative higher amounts of metallurgical bonds as well as physical/mechanical bonds between the base metal of a reactive alloy and a coating allows more effective coating of such metals. Additionally, coating processes utilizing activated liquids consistent with the present invention allow the formation of high bond strengths to metals such as iron and steels.

Consistent with the present invention, specially designed alloy melts containing combinations of oxide forming/deoxidizing transition metals including manganese (Mn), chromium (Cr), vanadium (V); titanium (Ti), zirconium (Zr), hafnium (Hf), niobium (Nb), tantalum (Ta), aluminum (Al), and the lanthanide metals (Lanthanum>>Lutetium) in combination with oxygen seeking nonmetals/metalloids such as silicon (Si), carbon (C), boron (B), phosphorous (P), and sulfur (S) which may all be used in coating processes. Desirably, the liquid melt may be provided having selected fractions of the deoxidizing alloying elements. The fraction of deoxidizing elements is between 5 and 70 percent, and all increments therebetween.

The liquid melt containing such fractions of the deoxidizing elements generally have a low tendency to form compounds between the alloying ingredients, thereby preserving their ability to reduce the oxides on a given substrate. Additionally, in a preferred embodiment of the invention no primary precipitates form employing such deoxidizing elements in the liquid melt. Thus, in the preferred case, the entire fraction of deoxidizing elements remain dissolved in the alloy melt, and alloy melt that is formed retains a high activity and affinity for oxygen. However, it should be understood that liquid melts consistent with the present invention may form small amounts of primary precipitates that will result in a reduction in the overall activity of the liquid melt.

The high activity liquid melts may be formed during the actual process of forming a coating on a substrate, including when powder or wire become molten as it passes through a plasma, high velocity oxyfuel (HVOF), flame spray, or wire-arc thermal spray system. These activated melts may be directed toward/applied to a surface of a metal that is to be coated. As the melt is applied to the oxidized surface of the metal to be coated, the surface is scrubbed clean of its native or residual oxide layer due, at least in part, to the presence of selected concentrations of unbound oxide forming elements. The relatively clean metal surface may then be susceptible to receipt of a metallic coating that may be bound to the metal surface via a combination of strong metallurgical bonds, along with the conventional but weaker physical/mechanical bonds.

The scrubbing/deoxidizing action provided by the activated liquid melts may even allow spraying relatively strongly bound coatings onto metal surfaces that are usually very difficult to bond to, including stainless steel alloys, aluminum alloys, and refractory metals such as tungsten, zirconium and titanium.

EXPERIMENTAL EXAMPLES

Exemplary coating alloys were produced including highly active materials consistent with the present invention, including Super Hard Steel™ coating compositions which are an iron based glass forming alloys that exhibit extreme hardness when processed by various methods into high performance coatings.

Bond strength tests were conducted using two types of feedstock. First, a high velocity oxy-fuel sprayed coating was provided to a substrate using an atomized powder having a composition of 60.1 wt % iron, 2.3 wt % manganese, 20.3 wt % chromium, 4.9 wt % molybdenum, 6.4 wt % tungsten, 3.6 wt % boron, 1.0 wt % carbon, and 1.4 wt % silicon and a nominal particle size in the range of 22 to 53 microns. Second, a wire-arc sprayed coating was applied to a substrate using a cored wire having a 1/16 inch diameter and a composition of 68.0 wt % iron, 23.2 wt % chromium, 1.2 wt % molybdenum, 1.5 wt % tungsten, 3.6 wt % boron, 0.9 wt % carbon, 0.7 wt % silicon, and 0.8 wt % manganese.

Bond strength testing was conducted consistent with ASTM c633. The results of the bond strength testing are provided in Table 1 below.

TABLE 1

Summary Of Bond Strength Data (ASTM c633)

| Spray Method | substrate | thickness | Bond strength (psi) | Failure Mode |
|---|---|---|---|---|
| HVOF | carbon steel | 40 mil | 14307 | Adhesive Failure |
| HVOF | carbon steel | 40 mil | 13864 | Adhesive Failure |
| HVOF | carbon steel | 40 mil | 13591 | Adhesive Failure |
| HVOF | 316 stainless steel | 40 mil | 13958 | Adhesive Failure |
| HVOF | 316 stainless steel | 40 mil | 14502 | Adhesive Failure |
| HVOF | 316 stainless steel | 40 mil | 13368 | Adhesive Failure |
| HVOF | aluminum | 40 mil | 13132 | Adhesive Failure |
| HVOF | aluminum | 40 mil | 12436 | Adhesive Failure |
| HVOF | aluminum | 40 mil | 13205 | Adhesive Failure |
| HVOF | carbon steel | 110 mil | 12738 | Coating Failure - bottom |
| HVOF | carbon steel | 110 mil | 13059 | Adhesive Failure 60% - Coating break 40% |
| HVOF | carbon steel | 110 mil | 12052 | Adhesive Failure 60% - Coating break 40% |
| Wire Arc | carbon steel | 40 mil | 11199 | Coating Failure - middle |
| Wire Arc | carbon steel | 40 mil | 11396 | Coating Failure - middle |
| Wire Arc | carbon steel | 40 mil | 10386 | Coating Failure - middle |
| Wire Arc | 316 stainless steel | 40 mil | 9562 | Coating Failure - middle |
| Wire Arc | 316 stainless steel | 40 mil | 9643 | Coating Failure - middle |
| Wire Arc | 316 stainless steel | 40 mil | 9530 | Coating Failure - middle |
| Wire Arc | aluminum | 40 mil | 5492 | Coating Failure - middle |
| Wire Arc | aluminum | 40 mil | 5501 | Coating Failure - middle |
| Wire Arc | aluminum | 40 mil | 6461 | Coating Failure - middle |

From the reported data above, it can be seen that with HVOF spraying, the bond strength does not appear to change as a function of substrate material, i.e. carbon steel, stainless steel, or aluminum. Additionally, there is only very limited decreases in bond strength on increasing coating thickness from 40 mil to 110 mil in thickness. However, when spraying the coating using wire-arc, there is found to be a reduction in bond strength depending on the substrate material. However, even the lower 5500 to 6500 psi bond strength realized when the coating is applied to an aluminum substrate is very good compared to other wire-arc alloys sprayed onto aluminum. The data collected using high velocity oxy-fuel spraying is graphically presented in FIG. 1.

The collected values of bond strength are remarkable for several reasons. First, ASTM C633 standard requires that the coating be a minimum of 0.015 inches in thickness and most tests are carried out on coatings sprayed to thicknesses that are very close to this minimum because as the coating becomes thicker the chance of developing a critical flaw in the coating leading to premature failure is much greater. Second, the results of the tests were remarkable because, when failure of the coating was observed, the coating generally failed due to a critical flaw arising from the spray process. Thus, the failure of the coatings, when failure was found, did not generally occur at the coating/metal substrate interface, indicating an extremely effective metallurgical metal to metal bond which is formed as a result of the cleansing of the native oxide layer of the substrate. Such effect had not previously been observed with thermal spray coatings. Finally, the magnitude of the bond strength of the high velocity oxy-fuel coatings (12,000 to >14,000 psi) is exceptional for metallic coatings, and is even superior to the bond strength of materials that are specifically used as intermediate bond coats, such as 75B Nickel Aluminides that generally provide bond strengths in the range of about 7,000 psi.

What is claimed is:

1. A method of forming a metallic coating on an oxidized metal surface layer comprising:

providing an atomized glass forming iron based metallic coating alloy wherein said alloy includes deoxidizing elements and an oxygen seeking nonmetal/metalloid, wherein said alloy consists of iron, manganese, chromium, molybdenum, tungsten, boron, carbon and silicon, wherein the elements are combined and present at a total of 100 wt %; and forming a metallic coating containing a fraction of metallic glass at a thickness of 40 mil to 110 mil by high velocity oxy fuel spray by melting said iron based metallic coating alloy to a liquid state;

applying said liquid melt of said iron based metallic coating alloy to said oxidized metal surface, wherein said oxidized metal surface comprises a native oxide layer and removing said oxidized metal surface layer with said liquid melt of said iron based metallic coating alloy to provide a metal surface that is relatively clean of said oxidized metal surface layer and susceptible to receipt of a metallic coating and wherein said deoxidizing elements remove oxygen from the metal surface layer and said deoxidizing elements are present in said alloy melt such that said deoxidizing elements remain dissolved in said alloy melt to retain an affinity for oxygen and no primary precipitates are allowed to be formed in said alloy melt from said deoxidizing elements; and applying an iron based metallic coating alloy to said metal surface that is relatively clean of said oxidized metal surface layer wherein said iron based metallic coating has an ASTM C633 bond strength of at least about 12,000 psi without using a bond coat and said bond strength is present at said coating thickness from 40 mil to 110 mil and wherein failure of said coating does not occur at a coating/metal surface interface.

2. The method of claim 1 wherein said step of melting said iron based alloy to a liquid state comprises forming a liquid state with no precipitates of said deoxidizing elements existing in said liquid state.

3. A method of forming a metallic coating on an oxidized metal surface layer comprising:

providing an atomized glass forming iron based metallic coating alloy wherein said alloy includes deoxidizing elements and an oxygen seeking nonmetal/metalloid, wherein said alloy consists of iron, manganese, chromium, molybdenum, tungsten, boron, carbon and silicon, wherein the elements are combined and present at a total of 100 wt %; and forming a metallic coating containing a fraction of metallic glass at a thickness of 40 mil by wire arc spray by melting said iron based metallic coating alloy to a liquid state;

applying said liquid melt of said iron based metallic coating alloy to said oxidized metal surface, wherein said oxidized metal surface comprises a native oxide layer and removing said oxidized metal surface layer with said liquid melt of said iron based metallic coating alloy to provide a metal surface that is relatively clean of said oxidized metal surface layer and susceptible to receipt of a metallic coating and wherein said deoxidizing elements remove oxygen from the metal surface layer and said deoxidizing elements are present in said alloy melt such that said deoxidizing elements remain dissolved in said alloy melt to retain an affinity for oxygen and no primary precipitates are allowed to be formed in said alloy melt from said deoxidizing elements; and applying an iron based metallic coating alloy to said metal surface that is relatively clean of said oxidized metal surface layer wherein said iron based metallic coating has an ASTM C633 bond strength of at least 5501 psi without using a bond coat and said bond strength is present at said coating thickness from 40 mil and wherein failure of said coating does not occur at a coating/metal surface interface.

4. The method of claim 3 wherein said step of melting said iron based alloy to a liquid state comprises forming a liquid state with no precipitates of said deoxidizing elements existing in said liquid state.

* * * * *